US006522110B1

(12) United States Patent
Ivanov

(10) Patent No.: US 6,522,110 B1
(45) Date of Patent: Feb. 18, 2003

(54) MULTIPLE OUTPUT SWITCHING REGULATOR

(75) Inventor: Vadim V. Ivanov, Tucson, AZ (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/011,213

(22) Filed: Oct. 23, 2001

(51) Int. Cl.[7] ..... G05F 1/577
(52) U.S. Cl. ..... 323/267; 307/41; 307/39
(58) Field of Search ..... 323/267, 283, 323/284, 224; 307/31, 38, 41, 39

(56) References Cited

U.S. PATENT DOCUMENTS 4,395,675 A 7/1983 Toumani
4,578,630 A 3/1986 Grosch
5,084,666 A * 1/1992 Bolash ..... 323/267
5,386,359 A * 1/1995 Nochi ..... 323/282
5,436,818 A 7/1995 Barthold
5,528,125 A 6/1996 Marshall et al.
5,602,463 A 2/1997 Bendall et al.
6,087,817 A * 7/2000 Varga ..... 323/266

OTHER PUBLICATIONS

Special Configurations–13 Cuk and SEPIC Switching Cells, pp. 175–208. No Date No Author.

* cited by examiner

*Primary Examiner*—Shawn Riley
(74) *Attorney, Agent, or Firm*—W. Daniel Swayze, Jr.; W. James Brady; Frederick J. Telecky, Jr.

(57) ABSTRACT

A voltage regulator is provided for taking an input voltage and providing a multiple of output voltages of differing voltage values. The voltage regulator includes a power switch and an inductor for providing inductor current to various output nodes. Control switches and a decision logic block are used to regulate the flow of inductor current to the output nodes, in accordance with predetermined values stored in the decision logic block. In one exemplary arrangement, the voltage regulator may provide a multiple of positive and negative voltage outputs. In another arrangement, the voltage regulator may provide a multiple of positive or negative voltage outputs or both.

22 Claims, 5 Drawing Sheets

MULTIPLE OUTPUT SWITCHING REGULATOR

BACKGROUND OF THE INVENTION

1. Field of the Invention

This invention generally relates to a DC to DC regulator, and more particularly, to a system and method which is capable of converting a DC input voltage to multiple DC output voltages.

2. Description of the Related Art

In general, a DC to DC voltage regulator may be used to convert a DC input voltage to either a higher or a lower DC output voltage. DC to DC converters with step-up/step-down characteristics are often required in applications where the input voltage and the output voltage requirements are incompatible. For example, where an input voltage is 120 volts, a DC to DC converter may be required to step down the input voltage to a voltage level suitable for use by a particular system, such as, for example, down to 5 volts. Moreover, some operational systems may require multiple outputs voltages. Such applications may require a regulated power supply which is capable of providing output voltages of more than one value (e.g., a computer BUS system requiring −12, +12, −5, +5 volts).

An example of a typical DC to DC voltage regulator which may be found in the prior art is disclosed in U.S. Pat. No. 5,436,818 issued Jul. 25, 1995 to Barthold ("Barthold"). Barthold purportedly discloses an improved regulator using at least two off-chip transformer components in an integrated buck-boost and buck converter system for eliminating the buck converter RHP zero effect characteristic. It should be noted, however, that where off-chip devices such as transformers are used, the off-chip devices necessarily increase the size and board space needed to implement the regulator design. Consequently, with the Barthold regulator, adequate space must be available to accommodate the bulk of the system transformers. This, in turn, results in a less space and cost efficient regulator device. As a result, recent regulator design efforts have focused on ways to implement a voltage regulator system while simultaneously reducing the number of off-chip devices employed.

With the above cost and space considerations in mind, more recent converter designs typically focus on switching regulators which minimize the use of transformers by primarily using integrated circuit technology (e.g., transistors, diodes, etc.) and passive electrical components (e.g., discrete storage inductors and filter capacitors). Typically, a switching regulator may control the voltage output by using one or more switches that are rapidly opened and closed to facilitate the transfer of energy between an inductor (a stand-alone inductor or a transformer, as examples) and an input voltage source. By regulating the voltage transfer in this way, the DC to DC switching regulator may control the value and position of the system DC voltage output.

One example in the prior art of a switching regulator using integrated circuit technology is the buck-boost switching regulator, described, for example, in U.S. Pat. No. 4,578,630 issued Mar. 25, 1986 to Grosch ("Grosch"). Grosch purports to disclose a buck-boost switching regulator wherein separate signals are derived from a regulator output feedback signal for use individually in controlling the duty cycles of a multiplicity of regulator switches. Grosch further suggests variably controlling the regulator battery switch duty cycle and ground switch duty cycle so that at least one of the switches operates within a predetermined non-zero minimum duty cycle. In this way, Grosch purportedly uses multiple power switches in a design for converting a DC voltage input to a higher or lower DC voltage output.

One main drawback of the Grosch design is that the design requires additional circuitry which continues to consume valuable chip space. For example, in order to produce the separate signals derived from the regulator output, Grosch requires additional switching control circuitry for managing the maximum value of the voltage difference between the separate regulator signals. As can be understood, the additional circuitry continues to place certain cost and size limitations on the overall voltage regulator design.

Presently known DC to DC converters, therefore, remain inadequate, particularly in their ability to accommodate the trend toward producing smaller more cost efficient systems. Accordingly, an improved DC to DC converter circuit is needed which reduces the amount of off-chip devices (e.g., transformers, passive elements, etc.), as well as the amount of on chip circuitry used to generate the desired multiple output voltages. By reducing the amount of board space used, a voltage regulator designer may reduce the overall cost of a useful DC to DC converter system.

SUMMARY OF THE INVENTION

The present invention provides a DC to DC voltage regulator (e.g., converter) which addresses many of the shortcomings of the prior art. In accordance with various aspects of the present invention, a multiple output switching voltage regulator using a highly-efficient single power switching regulator with a single inductor and multiple regulated positive and negative outputs is provided. In accordance with one aspect of the present invention, the multiple output switching voltage regulator uses a voltage error signal to determine the sequence and/or priority of voltage output. That is, in one aspect of the present invention, the voltage output may be manipulated according to an error signal and the priority and sequence required at the voltage output.

In accordance With another exemplary embodiment of the system and method described herein, a voltage input is suitably connected to a current until the predetermined inductor current limit is reached. Control switches may then be used to provide the inductor current to a multiple of voltage outputs. The value of the voltage outputs is compared to a reference voltage for producing an error signal. The error signal is then provided to a decision logic block, which uses at least one of the inductor current value or error signal to determine the operational states of the control switches. The operational states of the control switches are determined such that the appropriate inductor current levels may be provided to the multiple voltage outputs, thereby controlling the order and priority of voltages output by the voltage regulation system.

In accordance with yet another aspect of the present invention, an inductor current is manipulated according to a error signal and the priority and sequence of the voltage regulator voltage output. In accordance with still another aspect of the present invention, the voltage regulator uses an inductor current to determine the sequence and/or priority of the voltage output.

In accordance with various other aspects of the present invention, a voltage regulator for generating multiple output voltages while reducing chip area by reducing the use of off-chip devices and/or circuitry is provided. In accordance with an exemplary embodiment, a voltage regulator is configured with a single power switch, single inductor element, error amplifiers, decision logic circuit (e.g. decision logic block), synchronous rectifiers or diodes, and switches. A predetermined inductor current value can be programmed into a decision logic block according to the requirements of the voltage output. The inductor current value may be further used to direct the inductor current to a specified voltage output. Moreover, an inductor current maximum value (e.g., an inductor current limit), may be programmed into the decision block for use in determining the maximum allowed value of the inductor current in the regulator, and for determining the priority and sequence for providing excess current to a voltage output.

In addition, an error signal can be generated based on the actual and desired voltage output, which may be used by the decision logic block to control the current provided to the voltage outputs by the inductor element. That is, the decision logic block may use the information provided by the error signal and inductor current to control the sequence and priority of switch operational modes which may be used to generate the desired voltage output.

Power switching regulator with single inductor and multiple regulated positive and/or negative outputs is provided, wherein the regulator includes an integrated circuit In accordance with yet another exemplary embodiment of the present invention, a single power switching regulator with single inductor and multiple regulated positive and/or negative outputs is provided, wherein the regulator includes decision logic block for controlling the regulator output voltage priority and/or sequence.

In accordance with still another exemplary embodiment of the present invention, a single power switching regulator with single inductor and multiple regulated positive and/or negative outputs is provided, wherein the regulator uses a single inductor to provide current to the regulator outputs.

In another exemplary embodiment of the present invention, the inductor current is permitted to circulate throughout the voltage regulation system until called upon by the decision block to be provided to the voltage outputs.

In yet another exemplary embodiment of the present invention, the decision logic block may determine the state of the power switch and control switches, as well as, the inductor current to produce positive voltages, negative voltages or both.

BRIEF DESCRIPTION OF THE DRAWINGS FIGURES

A more complete understanding of the present description may be derived by referring to the various exemplary embodiments which are described in conjunction with the appended drawing figures in which like numerals denote like elements, and in which.

DETAILED DESCRIPTION OF VARIOUS EXEMPLARY EMBODIMENTS

The present description may be described herein in terms of functional block components and various processing steps. It should be appreciated that such functional blocks may be realized by any number of hardware components configured to perform the specified functions. For example, the present invention may employ various integrated circuit components, e.g., memory elements, digital signal processing elements, logic elements, look-up tables, and the like, which may carry out a variety of functions under the control of one or more microprocessors or other control devices. In addition, those skilled in the art will appreciate that the present invention may be practiced in any number of voltage regulation systems and that the voltage regulation system described herein is merely illustrative of the invention. Further, it should be noted that the present invention may employ any number of conventional techniques for voltage regulation, data transmission, signaling, signal processing and conditioning, and the like. Such general techniques that may be known to those skilled in the art are not described in detail herein.

It should be appreciated that the particular implementations shown and described herein are merely exemplary and are not otherwise intended to limit the scope of the present invention. Indeed, for the sake of brevity, conventional signal rectification, timing, synchronization, error amplification and conditioning, switching and power switching technologies, switching and diode polarity orientation and other functional aspects of a voltage regulation system (and components of the individual operating components of the system) may not be described in detail herein. Furthermore, the connecting lines shown in the various figures contained herein are intended to represent exemplary functional relationships and/or physical couplings between the various elements. Further still, it should be noted that many alternative or additional functional relationships or physical connections may be present in a practical communication system.

Figure 1:
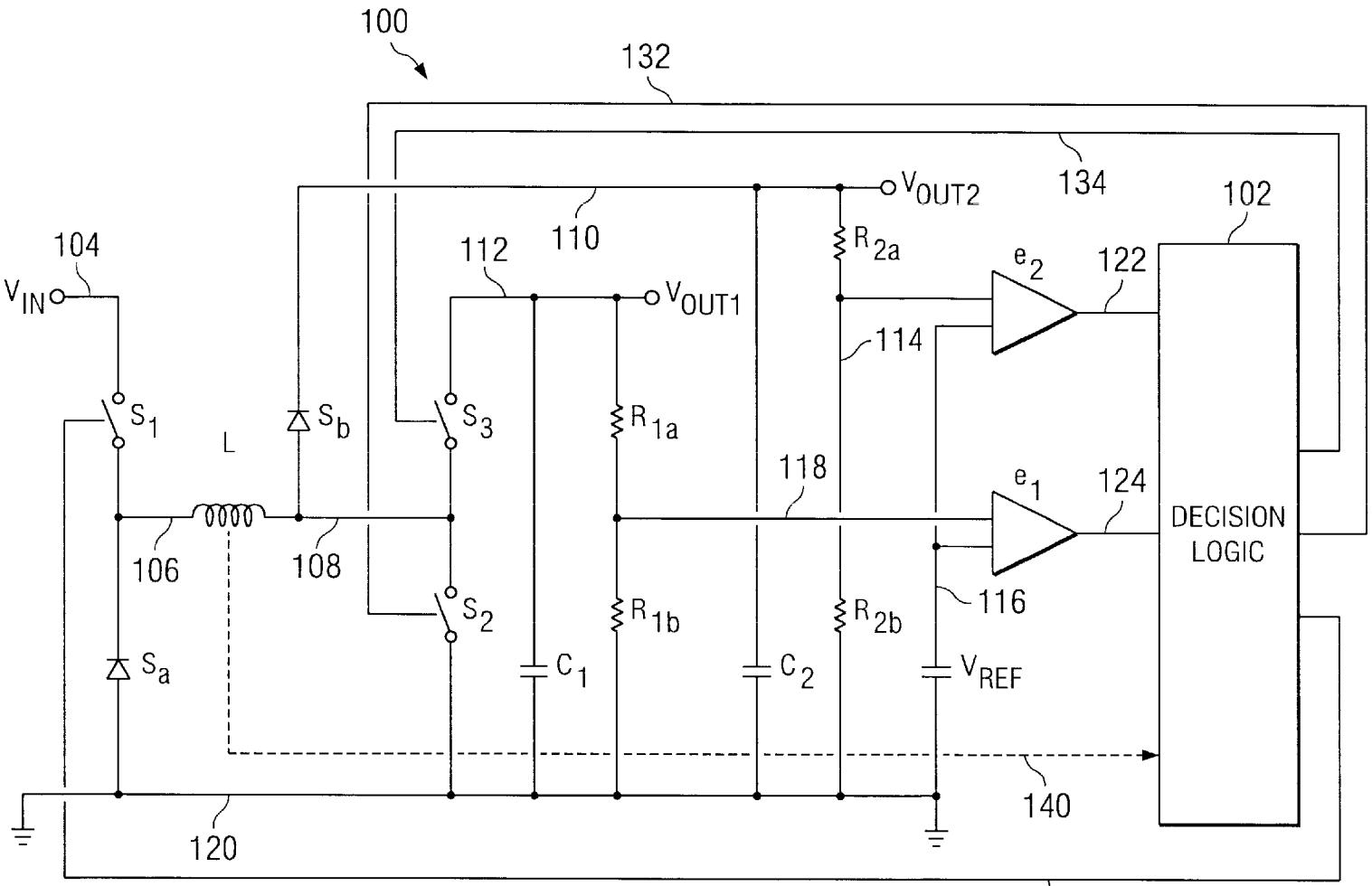
FIG. 1 illustrates a schematic diagram of an exemplary embodiment of a voltage tied regulator in accordance with the present invention.

To further explain in more detail various aspects of the present disclosure, exemplary embodiments of the voltage regulator disclosed herein will be provided. However, it should be noted that the following exemplary embodiments are for illustrative purposes, and that the present disclosure may comprise various other configurations consistent with a voltage regulation system. In addition, although not illustrated in the drawing figures, the voltage regulation system may further include components associated with a voltage regulation system, such as any required power sources, system control electronics or the like, which are commonly known in voltage regulator technology, although not described herein. With reference to FIG. 1, an exemplary embodiment of a voltage regulation system 100 in accordance with the present invention is shown. Voltage regulation system 100 includes diodes Sa and Sb, switches S1, S2, and S3, capacitors $C_1$ and $C_2$, error amplifiers $e_1$ and $e_2$, an inductor L, resistors $R_{1a}$, $R_{1b}$, $R_{2a}$, $R_{2b}$, and decision logic block 102. The various components of voltage regulation system 100 are interconnected via suitable connectors where the suitability or configuration of the connectors may be determined by the requirements of the system. Typical connectors for joining the components of system 100 are well known in the electronic and voltage regulation arts, and as such, will not be described herein in detail. For example, the connecting lines may comprise nodes, wherein a node may be represented by a line connector which typically may have a common voltage potential across the connector. In this regard, the words "node" and "connector" may be used interchangeably herein.

As shown, input voltage, $V_{in}$, is connected to switch S1 at node 104. Switch S1 is further connected to inductor L, and diode Sa at node 106. Inductor L is further connected to diode Sb and to switches S2 and S3 at node 108. Switch S3 is connected to output voltage $V_{out1}$, capacitor $C_1$, and resistor $R_{1a}$ at node 112. Resistor $R_{1a}$ is further connected to resistor $R_{1b}$ and error amplifier $e_1$ via node 118. Error amplifier $e_1$ is further connected to error amplifier $e_2$ and voltage reference $V_{ref}$ via node 116. The output of error amplifier $e_1$ is provided to decision logic block 102 via node 124.

Diode Sb is connected to a second output voltage $V_{out2}$, capacitor $C_2$, and resistor $R_{2a}$ at node 110. Resistor $R_{2a}$ is further connected to resistor $R_{2b}$ and error amplifier $e_2$ and via node 114. Error amplifier $e_2$ is further connected to error amplifier $e_1$ and voltage reference $V_{ref}$ via node 116. The output of error amplifier 21 is provided to decision logic block 102 via node 122.

Node 120 may be the place of lowest voltage potential in system 100. In one embodiment the lowest voltage potential may be ground or zero volts reference potential. As shown, diode Sa, switch S2, capacitors $C_1$ and $C_2$, resistors $R_{1b}$ and $R_{2b}$, and the negative end of voltage reference $V_{ref}$ and of error amplifiers $e_1$ and $e_2$ are connected to node 120.

In the embodiment of FIG. 1, the output of decision logic block 102 is provided to switches S1, S2, and S3 for controlling the active state of the switches as is described more fully below. The output of decision logic block 120 may be dependant on the value of the inductor current through inductor L and the values of output voltages $V_{out1}$, and $V_{out2}$ via error amplifiers $e_1$ and $e_2$, respectively. As such, the current through inductor L is provided to logic block 102 via connector 140, and the output of logic block 102 is provided to switch S1 via connector 130, to switch S2 via connector 132, and to switch S3 via connector 134.

Switches S1, S2, and S3 may be any conventional switch for allowing or inhibiting the flow of current through a connector. In addition, switches S1, S2, and S3 may be incorporated onto an integrated circuit chip (IC). A typical example of a suitable switch for use in this embodiment is a NMOS or PMOS transistor, IGBT transistor, bipolar transistor, or the like, although other switches known by those skilled in the art may be used. Such switches are commonly found in the voltage regulation art, and as such are well understood Consequently, in the interest of brevity, the construction and operation of switches S1, S2, and S3 will not be elaborated upon.

Diodes Sa and Sb may be any conventional diode structure such as for example a junction or schottky diode or synchronous rectifiers consisting of the NMOS or PMOS transistor and comparator. Further, diodes Sa and Sb may be used for reducing transient voltages that result from the switching of switches S1, S2, and/or S3, or may be used to limit the current flow through switches S1, S2, and/or S3.

Inductor L, capacitors $C_1$ and $C_2$ and, resistors $R_{1a}$, $R_{1b}$, $R_{2a}$ and $R_{2b}$ may be any conventional inductor, capacitors and resistors. In particular, inductor L may be any conventional inductor capable of providing an inductor current signal to decision logic block 102 or at output voltages $V_{out1}$, and $V_{out2}$. The value of the inductor may be chosen so current ripples during switching period are significantly less that maximum current permitted through the switches. Capacitors $C_1$ and $C_2$ may be any conventional capacitors for storing capacitive energy with respect to $V_{out1}$ and $V_{out2}$ respectively, and for supplying load currents in between pulses of inductor current with regard to these capacitors, thereby dampening the switch transients resulting from the switching of the switches S1, S2 and/or S3. In addition, capacitors $C_1$ and $C_2$ may provide a low impedance path for any fast moving switching transients. Also, Resistors $R_{1a}$ and $R_{1b}$, $R_{2a}$ and $R_{2b}$ may be any conventional resistors for allowing for the adjustment of the switching threshold of error amplifiers $e_1$ and $e_2$. In particular, $R_{1a}$ and $R_{1b}$ may reduce the voltage signal of $V_{out1}$ which is provided to $e_1$, and $R_{2a}$ and $R_{2b}$ may reduce the voltage signal of $V_{out2}$ which is provided to $e_2$, so that signals from $V_{out1}$, and $V_{out2}$ may be compared against the internal reference voltage $V_{ref}$.

The internal reference voltage signal $V_{ref}$ may be provided by a bandgap or other type of reference voltage suppliers, such as zener or external voltages.

Error amplifiers $e_1$ and $e_2$ may be any suitable amplifier capable of comparing two signals and providing an error signal. The construction and operation of error amplifiers is well known and, as such, will not be discussed in detail, herein With respect to voltage regulation system 100, error amplifier $e_1$ is capable of receiving the value of voltage output $V_{out1}$, and comparing $V_{out1}$ to a voltage reference, $V_{ref}$, prior to providing the corresponding error signal to decision logic block 102 via connector 124. Similarly, error amplifier $e_1$ is capable of receiving the value of voltage output $V_{out2}$ and comparing $V_{out2}$ to a voltage reference, $V_{ref}$, prior to providing the corresponding error signal to decision logic block 102 via connector 122.

Decision logic block 102 may be any suitable logic structure for receiving the current value from inductor L, and the error signals from error amplifiers $e_1$ and $e_2$, and providing signals representative of the preferred ON/OFF states of switches S1, S2 and S3. That is, the signals provided by decision logic block 102 may be any typical signal for controlling the operational states of switches S1, S2, and S3. For example, the signals may prompt switch S1, S2, and/or S3 to close to allow the free-flowing of current. On the other hand, the signal provided by decision block 102 may prompt one or more of the switches to open to inhibit the flow of current.

Having described various aspects and features of the voltage regulation system 100, the operation of the system will now be described. With respect to the following description, the operation of diodes, switches, inductors, capacitors, resistors, and error amplifiers will not be described in great detail since these elements are well known in the art. Further, although the present embodiment will be described with respect to the providing of a voltage output generally, it is to be understood that the present disclosure is not so limited. For example, the exemplary embodiment of FIG. 1 may be used to produce both positive and negative voltage outputs, or multiples thereof, as desired.

During operation, $V_{in}$ provides a voltage input to switch S1, which may initially be in the ON ("closed") position. With S1 in the closed position, current flows through inductor L to node 108. The inductor L then begins to charge. Once the inductor L charge reaches a predetermined value referred to as the inductor current limit value, the inductor begins to discharge, thus providing the inductor charge to node 108 and to decision logic block 102 via connector 140. Decision logic block 102 may then processes the inductor charge information to determine the desired operational states of switches S2 and S3. For example, the decision block 102 may use the opening and closing of switches S2 and S3 to utilize the average of the output voltages to control the value of the inductor current. Additionally, the decision block may use the operational states of the switches and the maximum of the errors to control in which load the inductor current is channeled during the current conducting period. Where the decision logic block 102 prompts switch S3 to close, the discharging of inductor L may cause storage capacitor $C_1$ to charge. Inductor L current may then flow through resistors $R_{1a}$ and $R_{1b}$, such that a voltage $V_{out1}$, is provided at node 112. Similarly, where the decision logic block 102 prompts switch S2 to close, the discharging of inductor L may cause storage capacitor $C_2$ to charge. Inductor L current may then flow through resistors $R_{2a}$ and $R_{2b}$, such that a voltage $V_{out2}$ is provided at node 110.

At node 118, error amplifier $e_1$ may then be provided the value of the voltage drop across resistor $R_{1a}$ so that the voltage at node 118 may be compared with the voltage provided by voltage reference $V_{ref}$. The resulting error value is then provided to decision logic block 102, where it may be used along with the inductor L current information to determine the desired operational states of switches S1, S2, and S3. That is, the operational states of S1, S2, and S3 may be determined in accordance with the value of the inductor current and according to which load is to be provided the inductor current. For example, in accordance with the information received, decision logic block 102 may prompt witches S1 and S2 to be ON throughout the a whole clock cycle to increase the value of the inductor current (e.g., the conducting period). Alternatively, where the inductor current may exceed a current limit value, then switch S1 may be OFF and S3 maybe ON or OFF depending on which load may require the inductor current. With S2 OFF and S3 ON, current may be provided to a first load at node 112. Similarly, with S3 OFF and S2 ON, current may be provided to a second load at node 110. Further, with S3 OFF and S2 ON, inductor current may circulate in the circuit loop defined by switches Sa and S2 until the inductor current is required by an attached load.

Figure 2A:
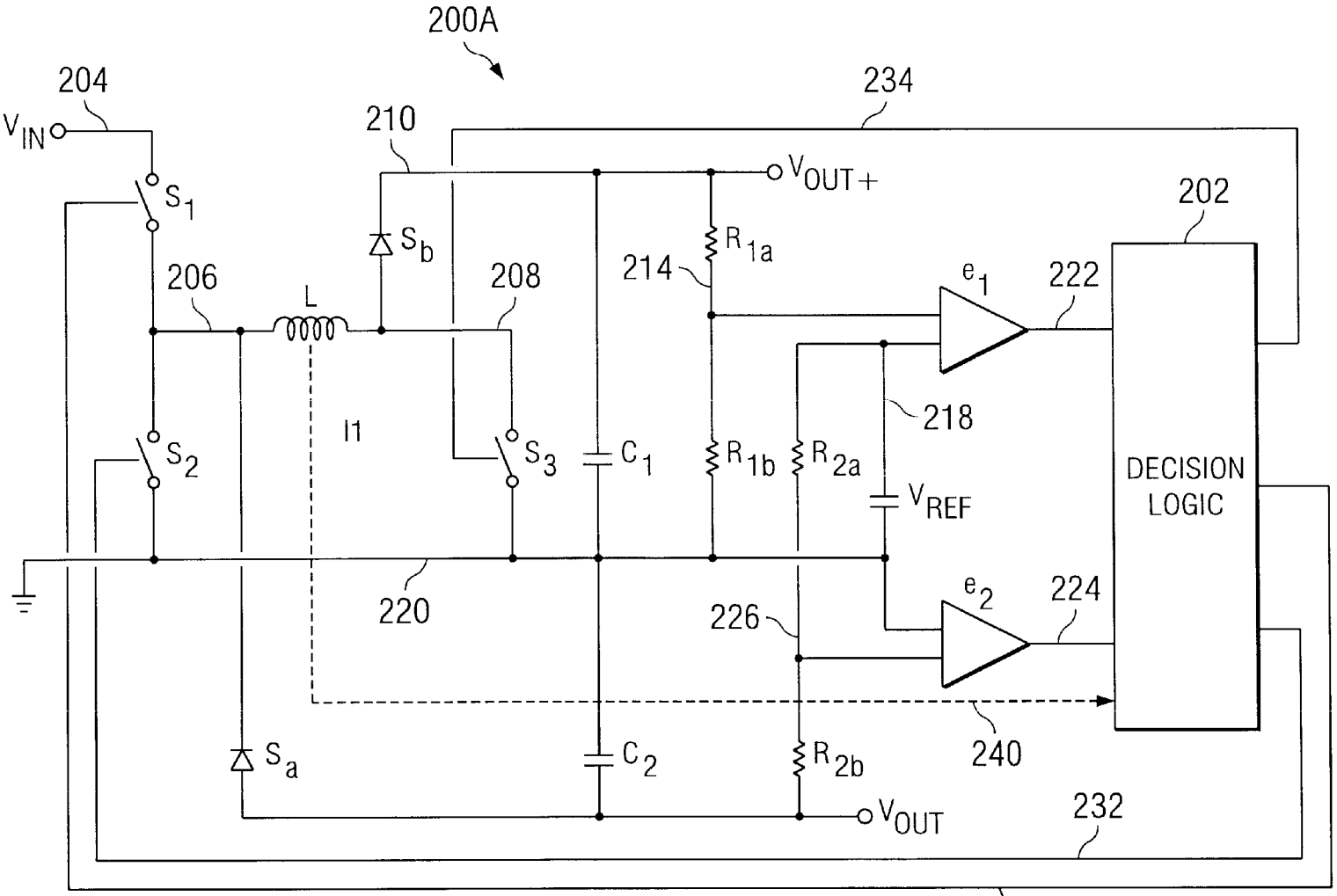
FIG. 2A illustrates a schematic diagram of an exemplary embodiment of a bipolar voltage regulator in accordance with the present invention.

FIG. 2A is a schematic drawing of another exemplary embodiment, wherein a voltage regulator system 200A in accordance with the present invention is shown. The voltage regulator system 200A of FIG. 2A is a bipolar voltage regulator in that the regulator has both a positive voltage output, $V_{out+}$, and a negative voltage output, $V_{out-}$. The bipolar voltage regulator system 200A depicted includes diodes Sa and Sb, switches S1, S2, and S3, capacitors $C_1$ and $C_2$, error amplifiers $e_1$ and $e_2$, inductor L, resistors $R_{1a}$, $R_{1b}$, $R_{2a}$, $R_{2b}$, and decision logic block 102. As with FIG. 1, the various components of bipolar voltage regulation system 200A are interconnected via suitable connecting lines or nodes where the suitability of the connecting lines may be determined by the requirements of the system. In addition, similar components of FIG. 1 and FIG. 2A may have similar construction and operation, and as such, the description of the various components will not be repeated herein for brevity.

As shown, input voltage, $V_{in}$, is connected to switch S1 at node 204. Switch S1 is further connected to switch S2, diode Sa, and inductor L, at node 206. Inductor L is further connected to diode Sb and to switch S3 at node 208. Switch S3 is connected to decision logic block 202 via node 234, and to switch S2, capacitors $C_1$ and $C_2$, resistor $R_{1b}$, the negative terminal of reference voltage $V_{ref}$, and error amplifier $e_2$ at node 220 Switch S2 is further connected to decision logic block 202 via node 232, and diode Sb is further connected to capacitor $C_1$, resistor $R_{1a}$ and positive output voltage $V_{out+}$ via node 210. Resistor $R_{1a}$ is further connected to resistor $R_{1b}$ and error amplifier $e_1$ and via node 214. Error amplifier $e_1$ is further connected to resistor $R_{2a}$ and the positive terminal of voltage reference $V_{ref}$ via node 218. Resistor $R_{2a}$ is further connected to resistor $R_{2b}$ and to error amplifier $e_2$ via node 226. Resistor $R_{2b}$ is connected to capacitor $C_2$, diode Sa, and to negative output voltage $V_{out-}$ at node 228. The output of error amplifiers $e_1$ and $e_2$ are provided to decision logic block 202 via node 222 and 224 respectively.

In the embodiment shown in FIG. 2A, the output of decision logic block 202 is provided to switches S1, S2, and S3 for controlling the active state of the switches. The output of decision logic block 220 may be dependant on the value of the inductor current through inductor L and the values of output voltages $V_{out}$, and $V_{out2}$. As such, the current through inductor L is provided to logic block 202 via connector 240, and the output of logic block 202 is provided to switch S1 via connector 230, to switch S2 via connector 232, and to switch S3 via connector 234.

During operation, switch S1 of bipolar voltage regulator system 200A may initially be closed. Input voltage, $V_{in}$ may provide a voltage input to switch S1 which may cause current to flow through inductor L via node 206. The inductor L may then begin to charge up. Once the inductor L charge (e.g., inductor current) reaches a predetermined value referred to as the current limit value, the inductor may begin to discharge providing the inductor charge to node 208 and to decision logic block 202 via connector 240. Decision logic block 202 may then processes the inductor current information to determine the operational states of switches S2 and S3. For example, Switches S1 and S3 may be ON to rapidly increase the inductor current. If inductor current is needed at node 210 (at $V_{out+}$), then switch S3 may be turned OFF and switch S2 may be turned ON. If inductor current is required at $V_{out-}$ only, then switches S1 and S2 may be turned OFF and switch S3 may be turned ON. Further, if inductor current is required at both $V_{out+}$ and $V_{out-}$, then switches S2 and S3 may be turned OFF.

Where the decision logic block 202 prompts S3 to open, the discharging of inductor L may cause storage capacitor $C_1$ to charge. Inductor L current may then flow through resistors $R_{1a}$ and $R_{1b}$, such that a voltage $V_{out+}$ is provided at node 210. Similarly, where the decision logic block 202 prompts S2 to close, the discharging of inductor L causes storage capacitor $C_2$ to charge. Inductor L current may then flow through resistors $R_{2a}$ and $R_{2b}$, such that a voltage $V_{out-}$ is provided at node 228.

With switch S3 open, error amplifier $e_1$ may then be provided with the voltage drop across resistor $R_{1a}$ so that the voltage at node 214 may be compared with the positive voltage provided by voltage reference $V_{ref}$. The resulting error value may then be provided to decision logic block 202, where it may be used along with the information for inductor L current to determine the operation states of switches S1, S2, and S3. Similarly, with switch S2 closed, error amplifier $e_2$ may then be provided with the voltage drop across $R_{2b}$ so that the voltage at node 226 may be compared to the negative voltage provided by voltage reference $V_{ref}$. The resulting error value from $e_2$ may then be provided to decision logic block 202, where it may be used along with the information for inductor L current to determine the operation states of switches S1, S2, and S3 in the manner described above.

Figure 2B:
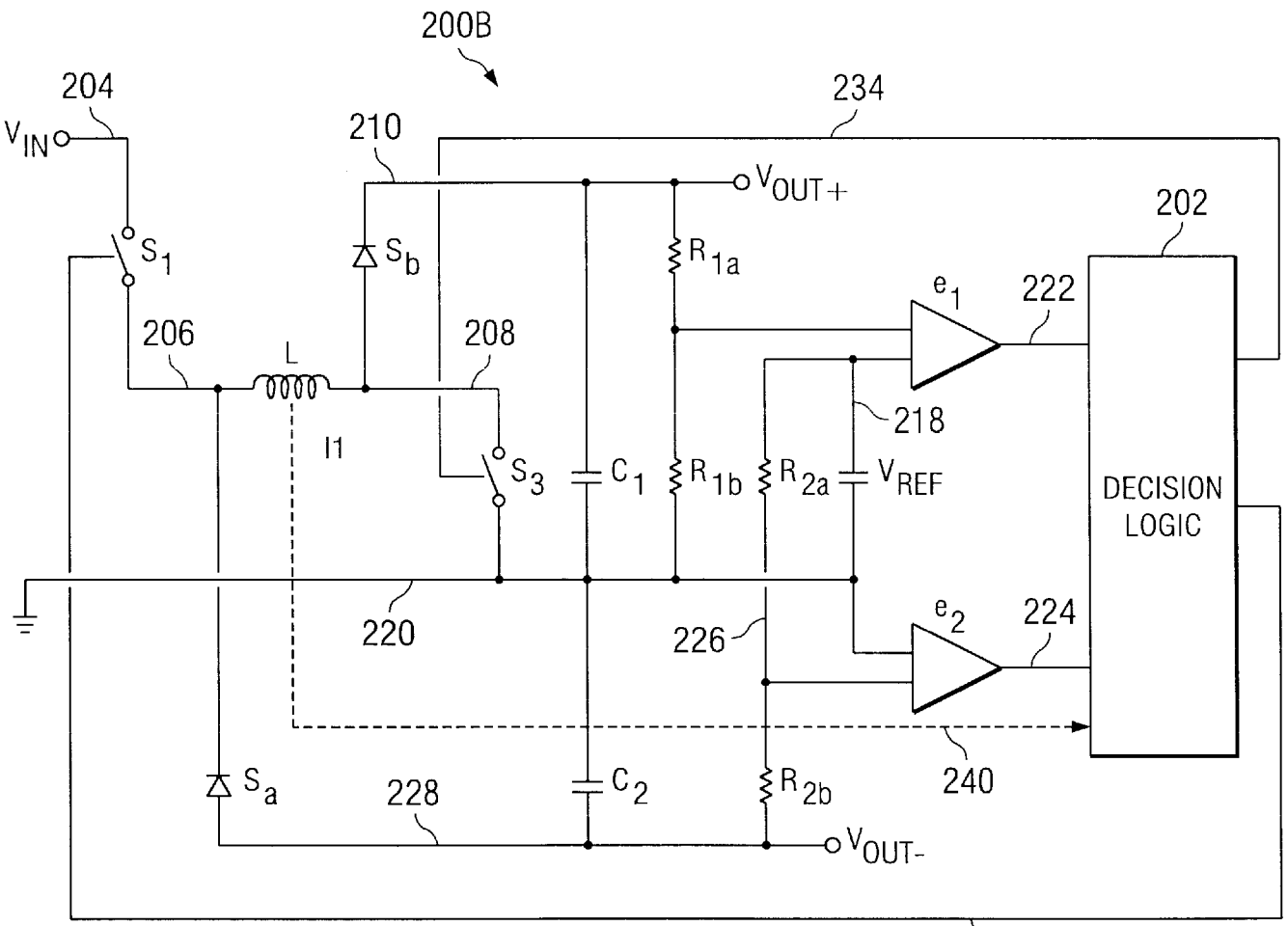
FIG. 2B illustrates a schematic diagram of another exemplary embodiment of a bipolar voltage regulator in accordance with the present invention.

FIG. 2B is another exemplary embodiment wherein a bipolar voltage regulator system 200B with limitations on the ratio of the currents available from the outputs is shown.

As can be seen, the bipolar voltage regulator system 200B of FIG. 2B is similar in construction to system 200A of FIG. 2A. It should be noted, however, that switch S2 and the control of switch S2 by decision logic block 202 has been removed. As such, since there is no S2 current, current can not flow from ground to the $V_{out+}$ and the charge transferred to the $V_{out-}$ may be equal or less than the charge transferred to the $V_{out+}$ in case of buck operation when $V_{in}$ is larger than $V_{out+}$.

Figure 3:
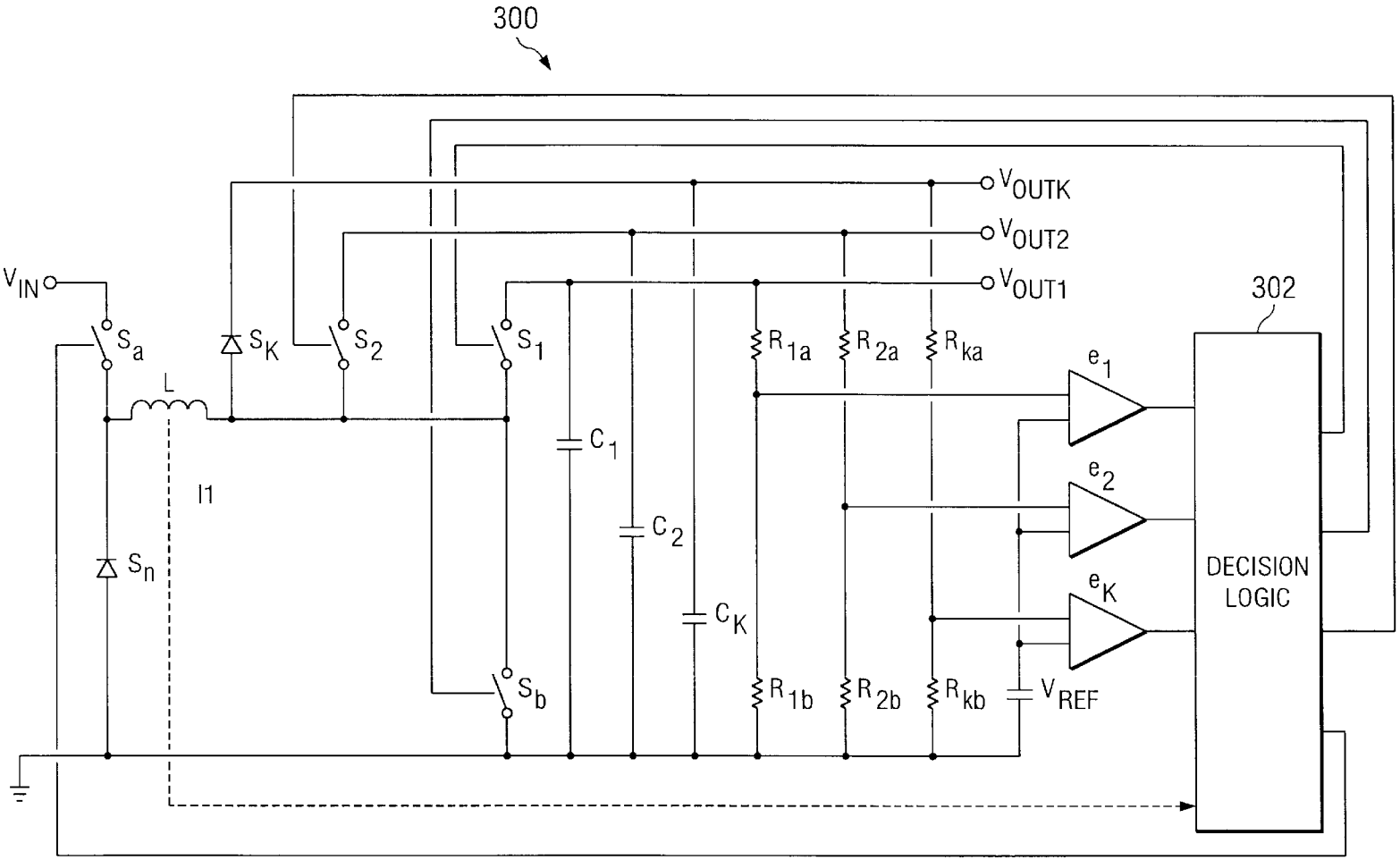
FIG. 3 illustrates a schematic diagram of an exemplary embodiment of a voltage regulator in accordance with the present invention.

With respect to FIG. 3, a voltage regulator system 300 with multiple positive outputs in accordance with another exemplary embodiment of the present invention is shown. It should be understood that while FIG. 3 depicts a system 300 with multiple positive outputs, the embodiment may be modified in ways understood by those skilled in the art to produce a voltage regulator system with multiple negative outputs. Such modifications may include, but are not limited to, connecting each of the negative outputs to the input side of the inductor through an appropriate switch in similar fashion as is shown with respect to S1 and S2. In this manner, the decision logic block may still determine the inductor current and the appropriate operational modes of the switches in similar manner as is described with respect to FIGS. 1 and 2.

In addition, while FIG. 3 shows voltage outputs $V_{out1}$, $V_{out2}$ and $V_{outk}$, the exemplary embodiment is not to be so limited. Indeed, the embodiment may be expanded to accommodate any number of output voltages required by a particular application employing the system 300. For example, system 300 may be expanded to include an output voltage $V_{outk+1}$, wherein the system 300 may be modified to include that diode Sk may be implemented as switch Sk. In addition, a diode Sk+1 may be included in series and connected to output voltage $V_{outk+1}$ in similar manner is done with respect to diode Sk depicted in system 300 of FIG. 3. In particular, it should be noted that where there are x number of voltage outputs, $V_{outx}$, the system will have a diode Sx interconnected between $V_{outx}$ and inductor L.

Further, a capacitor $C_{k+1}$ may be included connected to $V_{outk+1}$ and to the negative terminal of reference voltage $V_{ref}$, as with capacitor $C_k$ of system 300, and resistors $R_{k+1a}$ and $R_{k+1b}$ may be included in series and connected to $V_{outk+1}$ in similar manner as is done with resistors $R_{k1a}$ and $R_{k1b}$ shown in system 300. Further, an error amplifier $e_{k+1}$ may be included in the modified circuit such that error amplifier $e_{k+1}$may compare the voltage drop across $R_{k+1a}$ with the positive voltage provided by reference voltage $V_{ref}$. The resulting error signal from $e_{k+1}$ may then be provided to decision logic block 302 for use with the error signals provided by error amplifiers $e_1$, $e_2$, and $e_k$, and the value of inductor current provided by inductor L to determine the operation states of switches Sa, Sb, S1, S2, and Sk, in similar manner as is described above with respect to the preceding FIG. 1–2B. Consequently, it should be understood that in the manner described above, FIG. 3 may be modified to include further voltage outputs as required.

Figure 4:
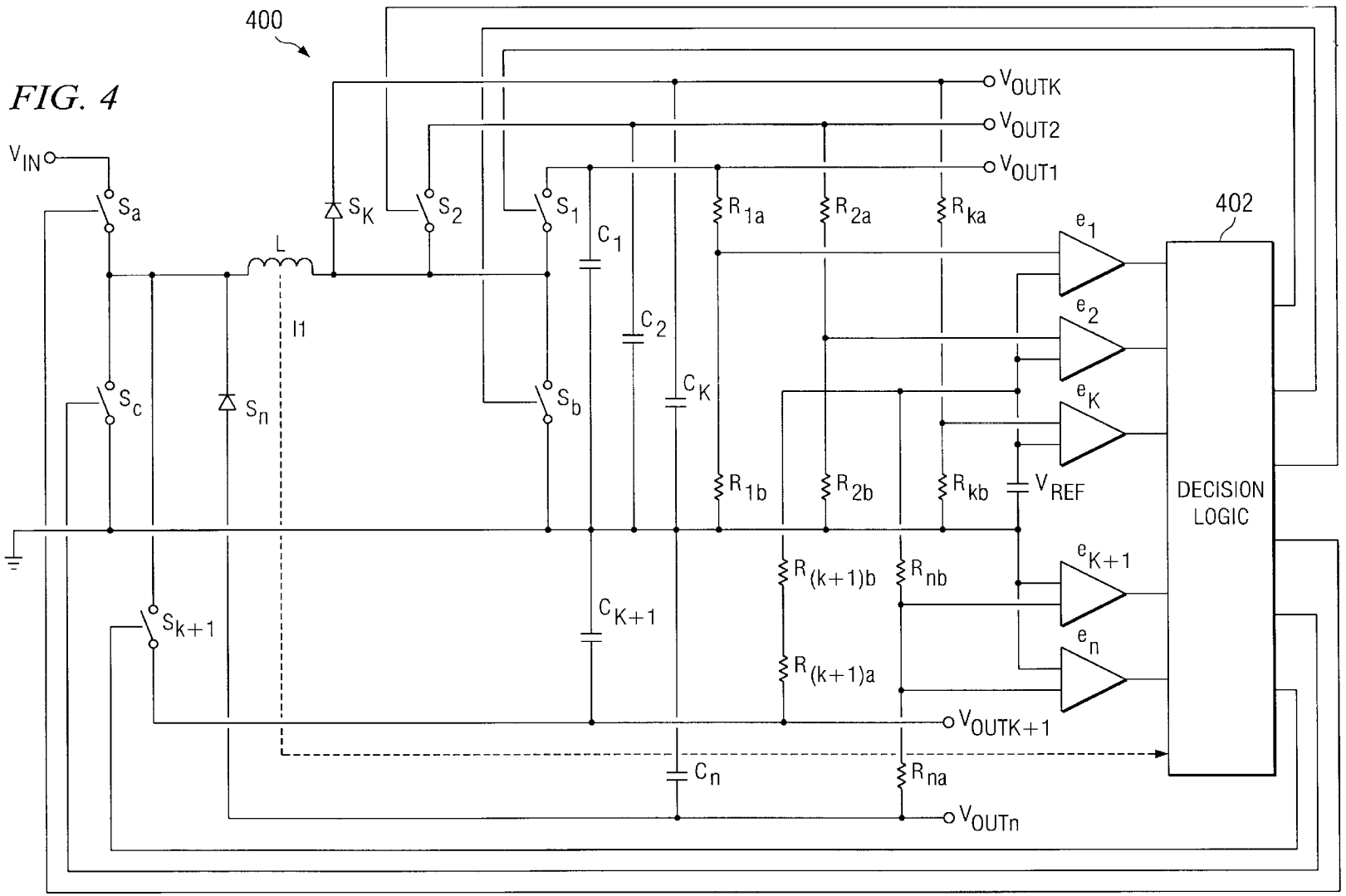
FIG. 4 illustrates a schematic diagram of an exemplary embodiment of a voltage regulator with multiple positive voltage outputs in accordance with the present invention.

FIG. 4 is yet another exemplary embodiment of the present invention wherein a voltage regulation system 400 having multiple positive and negative inputs is depicted. System 400 is of similar operation and construction as the systems previously described with respect to FIGS. 1–3. That is, similar components as those of FIGS. 1–3 with those of FIG. 4 have similar operation and construction. It should be noted, that similar to FIG. 3, however, FIG. 4 is not to be limited by the number of positive or negative voltage outputs depicted. Indeed, FIG. 4 may be modified to include any number of positive or negative output voltages, where such modifications may be made in similar manner as was described with respect to FIG. 3. In particular, where additional positive or negative voltage outputs, $V_{px}$ or $V_{nx}$, respectively are included in FIG. 4, diodes Sk and Sn may be implemented as switches Sk and Sn with similar construction and operation of switches S1 and S2, etc. Moreover, an additional diode $S_{px}$ (not shown) may be included interconnected between an additional positive output voltage $V_{px}$ and inductor L. An additional capacitor $C_{px}$ may be interconnected between additional positive voltage $V_{px}$ and the negative terminal of reference voltage $V_{ref}$ in similar manner as is provided with capacitors $C_1$, $C_2$, $C_k$ and $C_{k+1}$. Additional resistors $R_{pxa}$ and $R_{pxb}$ may be included in series interconnected between $V_{px}$ and the negative terminal of reference voltage $V_{ref}$ as is done with respect to resistors $R_{1a}$, and $R_{1b}$ of system 400. Further still, an error amplifier $e_{px}$ may be included to compare the voltage drop across resistor $R_{pxa}$ with the positive voltage provided by reference voltage $V_{ref}$ where such error output signal from $e_{px}$ may be provided to decision block 402 for use in controlling the operational modes of the various switches depicted in FIG. 4.

Moreover, it should be understood that in similar manner as was described above with respect to modifications which may be made to accommodate an additional positive output voltage $V_{px}$, FIG. 4 may be modified to accommodate an additional negative voltage $V_{nx}$. Namely, additional resistors, capacitors, diodes, and error amplifiers may be included in similar manner as described with respect to $V_{px}$. Consequently, the modifications which may be made will not be discussed in detail herein. It should be understood that the adding of additional negative output voltages may be accomplished with analogous adjustments as is described with respect to additional positive voltage output $V_{px}$. Further, it should be noted that where multiple additions of positive or negative voltage outputs are made, the outer most positive or negative output voltage may be connected to inductor L via an appropriate diode structure in similar manner as was done with the previous embodiments depicted herein showing multiple voltage outputs.

The present invention has been described above with reference to various exemplary embodiments. However, those skilled in the art will recognize that changes and modifications may be made to the exemplary embodiments without departing from the scope of the present invention. For example, the various operational steps, as well as the components for carrying out the operational steps, may be implemented in alternate ways depending upon the particular application or in consideration of any number of cost functions associated with the operation of the system, e.g., various of the steps may be deleted, modified, or combined with other steps. In addition, the various voltage regulation systems disclosed herein may be modified or changed to accommodate additional positive or negative output voltages as require by the application employing the regulation system. Further, it should be noted that while the voltage regulation system is described above is suitably for use in any system wherein it may be necessary to provide multiple positive and/or negative output voltages. The changes and/or modifications described above are intended to be included within the scope of the present disclosure, as set forth in the following claims.

I claim:

1. A voltage regulation system comprising:

a first power switch for regulating current input into said voltage regulation system;

an inductor for providing an inductor current to a plurality of voltage outputs, said plurality of voltage outputs comprising at least one of a first voltage output and a second voltage output;

a first switch for regulating said inductor current flow to said first voltage output;

a second switch for regulating said inductor current flow to said second voltage output, a reference voltage;

a first voltage error amplifier coupled to said voltage reference, said first voltage error amplifier for comparing said first voltage output to said voltage reference and providing a first error signal;

a second voltage error amplifier coupled to said voltage reference, said second voltage error amplifier for comparing said second voltage output to said voltage reference and providing a second error signal; and a decision logic block for receiving at least one of said inductor current, said first error signal and said second error signal and providing a control signal to at least one of said first power switch, said first switch and said second switch for controlling the operational states of at least one of said first power switch, said first switch and said second switch.

2. A voltage regulation system according to claim 1 wherein at least one of said first voltage output and said second voltage output is a positive voltage.

3. A voltage regulation system according to claim 1 wherein at least one of said first voltage output and said second voltage output is a negative voltage.

4. A voltage regulator system according to claim 1 wherein said decision logic block provides a control signal to at least one of said first power switch, said first switch and said second switch for controlling said inductor current.

5. A voltage regulator system according to claim 1 wherein said decision logic block provides a control signal to at least one of said first power switch, said first switch and said second switch in a predetermined sequence.

6. A voltage regulator system according to claim 5 wherein said predetermined sequence determines the priority and the sequence of providing said plurality of voltage outputs.

7. A voltage regulator system according to claim 1 wherein a predetermined inductor current limit is stored in said decision logic block, said predetermined inductor current limit for use in controlling the value of at least one of said plurality of voltage outputs.

8. A voltage regulator system according to claim 1 wherein said decision logic block provides a control signal to at least one of said first power switch, said first switch and said second switch in accordance with at least one of said operational states and the maximum of said first error signal and said second error signal.

9. A voltage regulation system according to claim 1 wherein inductor current is provided to at least one of said multiple voltage outputs in accordance with a control signal from said decision block.

10. A voltage system according to claim 1 wherein said plurality of voltage outputs comprise positive voltages.

11. A voltage system according to claim 1 wherein said plurality of voltage outputs comprise negative voltages.

12. A voltage system according to claim 1 further comprising at least a third switch for regulating said inductor current flow to at least one of said plurality of voltage outputs.

13. A voltage system according to claim 12 wherein said plurality of voltage outputs comprises at least a third voltage output.

14. A voltage regulation system according to claim 13 further comprising a third voltage error amplifier, said third voltage error amplifier for comparing said third voltage output to said voltage reference and providing a third error signal.

15. A voltage regulation system according to claim 14 wherein said decision logic block produces a control signal sequence for controlling at least one of said power switch, said first switch, said second switch and said third switch, said control signal sequence determined in accordance with at least one of the value of said inductor current, said first error signal, said second error signal and said third error signal.

16. A voltage regulation system comprising:

a power switch for regulating current input;

an inductor for providing inductor current to a plurality of voltage outputs;

a reference voltage;

a plurality of control switches for regulating the inductor current to said plurality of voltage outputs;

a plurality of error amplifiers coupled to said voltage reference, wherein and at least one of said number of error amplifiers corresponds to at least one of said plurality of voltage outputs, said one of said voltage error amplifiers for comparing said one of plurality of voltage outputs to said voltage reference and providing an error signal; and a decision logic block for receiving said inductor current and said error signal and providing a control signal to at least one of said power switch and said plurality of control switches for controlling the operational states of at least one of said power switch, and at least one of said plurality of control switches.

17. A voltage regulator system according to claim 16 wherein said decision logic block provides said control signal to said plurality of control switches in a predetermined sequence.

18. A voltage regulator system according to claim 17 wherein said predetermined sequence determines the priority and the sequence of providing said plurality of voltage outputs.

19. A voltage regulator system according to claim 16 wherein a predetermined inductor current limit is stored in said decision logic block, said predetermined inductor current limit for use in controlling the value of at least one of said plurality of voltage outputs.

20. A voltage regulator system according to claim 16 wherein said decision logic block provides a control signal to at least one of said plurality of control switches in accordance with at least one of said operational states and the maximum of said error signal.

21. A voltage regulation system according to claim 1 wherein said inductor current is provided to at least one of said multiple voltage outputs in accordance with said control signal from said decision block.

22. A voltage system according to claim 1 wherein said plurality of voltage outputs comprise at least one of positive voltages, negative voltages, and positive and negative voltages.

* * * * *